United States Patent [19]

Rebardi et al.

[11] Patent Number: 4,858,690

[45] Date of Patent: Aug. 22, 1989

[54] UPWARD MOVEMENT ONLY ACTUATED GRAVEL PACK SYSTEM

[75] Inventors: Wade A. Rebardi, Carencro; David L. Farley, Lafayette, both of La.

[73] Assignee: Completion Services, Inc., Lafayette, La.

[21] Appl. No.: 224,974

[22] Filed: Jul. 27, 1988

[51] Int. Cl.[4] ..... E21B 34/14; E21B 43/04

[52] U.S. Cl. ..... 166/278; 166/51; 166/113; 166/205; 166/334

[58] Field of Search ..... 166/386, 51, 185, 113, 166/205, 278, 373, 334, 332

[56] References Cited

U.S. PATENT DOCUMENTS

| | | | |
|---|---|---|---|
| 3,062,284 | 11/1962 | Brown | 166/278 |
| 4,401,158 | 8/1983 | Spencer et al. | 166/278 X |
| 4,428,428 | 1/1984 | Smyrl et al. | 166/278 |
| 4,474,239 | 10/1984 | Colomb et al. | 166/278 |
| 4,519,451 | 5/1985 | Gray et al. | 166/278 |
| 4,540,051 | 9/1985 | Schmuck et al. | 166/278 |
| 4,541,486 | 9/1985 | Wetzel et al. | 166/278 X |
| 4,566,538 | 1/1986 | Peterson | 166/278 |
| 4,633,944 | 1/1987 | Zunkel et al. | 166/278 X |

*Primary Examiner*—Bruce M. Kisliuk
*Attorney, Agent, or Firm*—David Alan Rose

[57] ABSTRACT

The gravel pack system includes a crossover assembly disposed within a screen assembly which has been adapted for disposal adjacent a producing formation within a well. The screen assembly includes a packet for sealing the annulus between the screen assembly and a well casing and a production screen disposed below the packer. The crossover assembly includes a wash pipe and a crossover tool adapted for suspension within the well on a pipe string for disposal within the screen assembly. Upon the disposal of the crossover assembly within the screen assembly, the assemblies together form an upper crossover valve, a lower crossover valve, a circulation valve, and a screen valve. These valves are selectively opened and closed for the various gravel pack operations by raising the crossover assembly within the screen assembly. The screen assembly and crossover assembly include a plurality of interference collars and collets whereby the crossover assembly is raised within the screen assembly to predetermined and positively indicated positions for carrying out the individual operations of the gravel pack.

38 Claims, 7 Drawing Sheets

UPWARD MOVEMENT ONLY ACTUATED GRAVEL PACK SYSTEM

BACKGROUND OF THE INVENTION

1. Field of the Invention

The present invention is directed to a gravel pack system, and more particularly to a gravel pack system which raises the crossover assembly within the screen assembly to position the system for each gravel pack operation.

2. Background of the Art

Sand flow from unconsolidated formations is controlled through chemical or mechanical means to prevent or correct a variety of potentially serious and costly problems, such as: production loss caused by sand bridging in casing, tubing and/or flow lines; failure of casing or liners due to the removal of surrounding formation, compaction and erosion; abrasion of downhole and surface equipment; and handling and disposal of unconsolidated materials from the recovered hydrocarbons. One mechanical means for correcting sand problems is the use of a gravel pack.

Gravel packing is a method of forming a filter of gravel between the oil, gas or water producing formation and the production pipe and if used in an uncased or open hole, will serve to support the unconsolidated formation. Normally, the production pipe is attached at its lower end to a section of pipe called a liner or screen which has been disposed adjacent the formation to be produced. The liner or screen has a plurality of narrow spaced apart slots or screen covered openings through which the formation fluids enter the production pipe from the formation. The body of gravel is interposed between the screen and the formation to serve as a filter to screen out the fine sand and the like as the well fluid flows from the formation into the screen so that the produced fluids may enter the production pipe free of the sand or unconsolidated material from the producing formation. Where the screen is set in an open hole, the gravel pack supports the unconsolidated formation. Where the screen is set inside a perforated casing, the gravel pack functions primarily as a filter with the casing assisting in supporting the unconsolidated formation.

In the completion of wells, it is known (1) to install a gravel pack assembly including a packer, liner and screen in the well casing adjacent the producing formation, and (2) to place gravel around the screen to a sufficient height to insure that the gravel will remain consolidated and not be displaced as it filters unconsolidated material out of the inflowing well fluid. The gravel is conducted down the well by a gravelling pipe string to the gravel pack assembly for placement outside the screen. A part of the operation is to apply pressure on the placed gravel or squeeze the gravel into the producing formation which contains or is producing unconsolidated material.

In a conventional gravel pack, the gravel pack assembly, including the hydraulic setting tool and crossover tool and the required screen and blank pipe, is run into the well. The packer is set using pump pressure applied to the pipe string. After the packer is seated, the crossover valve may be opened and closed by raising and lowering the crossover tool to carry out the gravelling operation. With the crossover valve closed, the packer may be pressure tested by pumping down the casing. Pumping down the pipe string and into the formation is done to establish an injection rate. The formation may be acidized or otherwise treated if needed. With the crossover valve open, a gravel slurry may be circulated to place the gravel outside the screen and into the formation until an adequate gravel pack is obtained. If desired, the crossover valve may be closed to apply pressure to the placed gravel and obtain a conventional squeeze pack. The excess slurry in the pipe string is removed by reverse circulation with the gravel packed formation isolated. This isolated formation provides a more positive means of excess slurry removal and helps protect the formation from circulation pressure and possible loss of circulation fluid. After the removal of the setting tool and crossover tool, a production packer seal assembly is left in the well for production of the formation.

An optional wire line-set sump packer may be utilized to provide a well bottom space for the settlement of fines produced or possible loss of wire line tools. The wire line-set sump packer also serves to locate the screen properly with reference to the perforations in the casing. Although sump packers are often used, alternatives include cement bottoms, bridge plugs or retainer bottoms.

Gravel packing wells involves a complicated series of tool movements to effectively place gravel around the screen and into the perforations. This multi-position approach to gravel packing has been perfected in recent years, and the results indicate improved pack performance. Almost all such gravel packs, however, have been done from a stationary surface, i.e. a land rig or a platform rig.

Special problems are posed with gravel packing from a floating vessel. Floating rigs and semi-submersibles have greatly increased the water depth for offshore exploration and production. Floating rigs can drill in water depths which cannot be reached by conventional jack-up rigs. Although much of the work done on floating rigs is exploration, some well completions are now being performed.

Floating rigs or semi-submersibles do not rest on the ocean bottom but float on the surface of the water. They are held in place by various anchoring systems and will move with the sea waves. The heaving or up and down movement of the floating rigs caused by the waves will vary depending upon the physical characteristic of the wave and the sea environment. Heave may vary from a few inches to thirty or forty feet in harsher environments. The speed at which the rig moves will be dependent upon the wave frequency.

If the pipe string extending to the subsea well is suspended from a floating rig, the string will move in response to the heave of the waves and the motion of the floating rig. To prevent the pipe string from varying in tension and compression due to the wave movement, compensators have been developed to permit the floating rig to move in response to the waves but yet cause a predetermined amount of weight to be placed on the block suspending the pipe string. This will permit the pipe string to be relatively stationary as the rig moves up and down in response to the ocean waves. The compensator is set for a predetermined total weight of the pipe string. As the rig moves up and down, the compensator adjusts to the friction resistance of the pipe being pulled through the fluid in the well bore. This friction force increases or decreases with the pipe weight, and the compensator adjusts to cause the pipe weight to be maintained at a prescribed level. This tends to dampen the pipe movement and causes it to be less than the movement of the rig.

In a conventional gravel pack, the packer is set and the crossover tool is released from the screen assembly so that it can then be moved to the various positions required for performing the gravel pack. During this positioning operation, the crossover tool is suspended on the work string. If conventional gravel pack tools are used on floating rigs, the movement of the rig is transmitted to the crossover tool during the positioning operation which causes the crossover tool to oscillate between positions causing problems in the gravelling operation.

When a gravel pack operation is attempted from a floating rig using a conventional gravel pack system, difficulty is experienced in determining with certainty that the gravel pack is deposited at the proper location relative to the formation. When gravel packing is between a screen and a casing having perforations opposite the producing formation, precise location of the gravel pack is especially important because the length of the perforated section of the casing will often be quite short and at great depths.

Unless the positioning of the crossover tool through which the gravel packing must be conducted is known and controlled, premature bridging by the gravel slurry often will occur at points above the desired location, e.g. between a screen and a casing, so that production is interfered with and ineffective support of the formation will occur. Moreover, with conventional gravel pack systems, no good indication can be obtained to apprise the operator that such bridging has occurred or as to its location relative to the producing formation.

U.S. Pat. No. 3,062,284 discloses a method for gravel packing a well. The specific apparatus employed is run into the well on a tool string to a point in which seals of the tool will be somewhat above the producing formation which is to be gravel packed. With the seals actuated and wash fluid, such as water or oil, being pumped down the operating string, the seals prevent the return flow of the fluid which results in back pressure being built up on the surface pump. Evidence of the build up of the pressure apprises the operator that the lower seal is above the perforations in the casing in a location of the gravel pack. Thereafter the tool string is lowered and the seal passes below the uncovered perforations in the casing which permits a washing operation to take place. The washing operation is continued with the tool string being lowered in short increments until the seal now is below all of the perforations in the casing. At this point of the operation, the return of fluids causes a back pressure in the pump. The operating string is then raised and lowered to set a liner hanger which is followed by raising the operating pipe while circulating a slurry of gravel. The operating pipe is elevated in short increments to progressively uncover the perforations providing a layering effect of the gravel as the operating pipe is raised. This method essentially has the two steps of washing and circulating a gravel slurry.

U.S. Pat. No. 4,474,239 discloses a method and apparatus for sand placement. The sand placement tool which is run into a well on a tubing provides an operation wherein the casing/tubing annulus is filled from the top down as compared to conventional tools and method where the casing/tubing annulus is filled from the bottom up.

U.S. Pat. No. 4,540,051 discloses a method and apparatus for gravel packing a cased well. The apparatus of this patent provides for the perforation of the casing at a production zone in a well and the subsequent gravel packing of a liner, screen or other filtering means positioned adjacent to the casing perforations with a single trip of the required apparatus into the well.

U.S. Pat. No. 4,541,486 is also directed to an apparatus which provides for the perforation of the casing at a production zone in a well and the subsequent gravel packing of a liner, screen, or other filtering means positioned adjacent to the casing perforations with a single trip of the required apparatus into the well.

U.S. Pat. No. 4,566,538 is directed to a method and apparatus for effecting the fail-safe perforating of a well casing. This patent is also related to the foregoing two patents.

Completion Services, Inc. of Lafayette, La., has a gravel pack system which is described in a brochure entitled "The Complete Gravel Pack" which is incorporated herein in its entirety by reference. The gravel pack system as described in this brochure is made up of a setting tool and crossover assembly and a liner and screen assembly. The liner and screen assembly of that system is made up of the following: a packer at the top of the assembly, a slotted perforated extension, a lower seal bore, an extension of pipe, a single interference collar, an extension of pipe, a production screen, and an O-ring sub and a tell tale screen below the production screen. Furthermore, there may be a sump-packer at the very bottom of the liner and screen assembly. Within the liner and screen assembly is a crossover assembly. The crossover assembly has an upper crossover section which includes an inner tube with a lower port which permits the fluid being injected into the tubing to be forced downwardly through the lower port and slotted perforated extension of the packer assembly to the producing area. The crossover assembly has at the lower end, a wash pipe connected to the upper crossover section for passage of fluid upwardly through the wash pipe and through an outer tube of the crossover section which has an upper port. The crossover assembly has seals around the periphery, at least one of which is above the upper port, and when seated within the seal bore of the upper packer of the liner and screen assembly, the seals close the upper port. The cooperating structure of the upper port, the seal above the port and the seal bore act as a valve for controlling the upward passage of fluid and thus function as a crossover valve. The liner and screen assembly and crossover assembly of this gravel pack system has a single crossover valve which is closed when the seal above the upper port of the crossover assembly is in contact with the seal bore of the packer and is opened when the crossover assembly is raised removing the seal from contact with the seal bore of the packer. In the operation of this gravel pack system the crossover assembly is sequentially raised opening the crossover valve and lowered a considerable distance to close this valve. This gravel pack system has great adaptability from a fixed rig. However, employing such a gravel pack system from a drilling vessel in constant motion caused by the waves, being raised and lowered in the water or heaving, the certainty of whether the crossover valve is open or closed cannot be determined and there is no compensation device or system to assure operational control.

According to the present invention, the gravel pack system provides structure which enables raising the crossover assembly to a fixed position within the screen assembly for each desired operation. Since the crossover tool becomes fixed before each operation, the fact that the operation is being carried out from a drilling vessel which has a constant heaving motion does not change the certainty of the position of the crossover tool within the well, and accordingly, the desired operation is carried out with the certainty that the system is in the desired position.

Conventional gravel packs require the pipe to be lowered following a circulating position to a squeeze position. The present invention does not require this, therefore minimizing the chance of sticking the crossover tool within the sand slurry. Lowering the pipe from one position to another while sand slurry is present in the crossover can cause a jamming effect between the crossover and seal or packer bore. The all up procedure of the present invention will minimize this deficiency.

Other more specific objects and advantages of the present invention will become more readily apparent from the following detailed description when read in conjunction with the accompanying drawings illustrating the embodiments in accordance with this invention.

SUMMARY OF THE INVENTION

The gravel pack system of the present invention includes a crossover assembly disposed within a screen assembly for location adjacent to a producing formation. The screen assembly includes a packer for sealing the annulus between the assembly and the well casing, and a production screen disposed below the packer. The crossover assembly is adapted for suspension within the well on a pipe string and is disposed within the screen assembly. The crossover assembly includes a wash pipe. The screen assembly and crossover assembly together form an upper crossover valve, a lower crossover valve, a circulation valve and a screen valve. The upper crossover valve opens and closes a flow path between the flow bore of the crossover assembly and the annulus between the pipe string and well casing above the packer, and the lower crossoyer valve opens and closes a flow path between the flow bore of the pipe string and the annulus below the packer between the screen assembly and the well casing. The circulation valve provides a flow path between the flow bore of the crossover assembly and the annulus below the packer between the screen assembly and the well casing. The screen valve opens and closes a flow path through the production screen between the flow bore of the wash pipe and the annulus below the packer between the screen assembly and the well casing.

The screen assembly and crossover assembly include a plurality of interference collars and collets whereby the crossover assembly is raised within the screen assembly to selectively open and close the various valves to carry out the individual operations of the gravel pack system. Thus, the crossover assembly is raised within the screen assembly to fixed positions to carry out the specific functions and steps of the gravel packing operation. Such gravel packing operations include a lower squeeze operation, a lower circulation operation, an upper squeeze operation, an upper circulation operation, and a reverse circulation operation, or a variation thereof. The interference collars and collets provide a positive indication that the gravel pack system has moved from one operating position to another. Each change in position for a different operation is accomplished by raising the crossover assembly within the screen assembly. Thus the operation of the gravel pack system of the present invention is an all up gravel pack system.

BRIEF DESCRIPTION OF THE DRAWINGS

For a detailed description of the preferred embodiments of the invention, reference will now be made to the accompanied drawings wherein.

DESCRIPTION OF THE INVENTION

Figure 1:
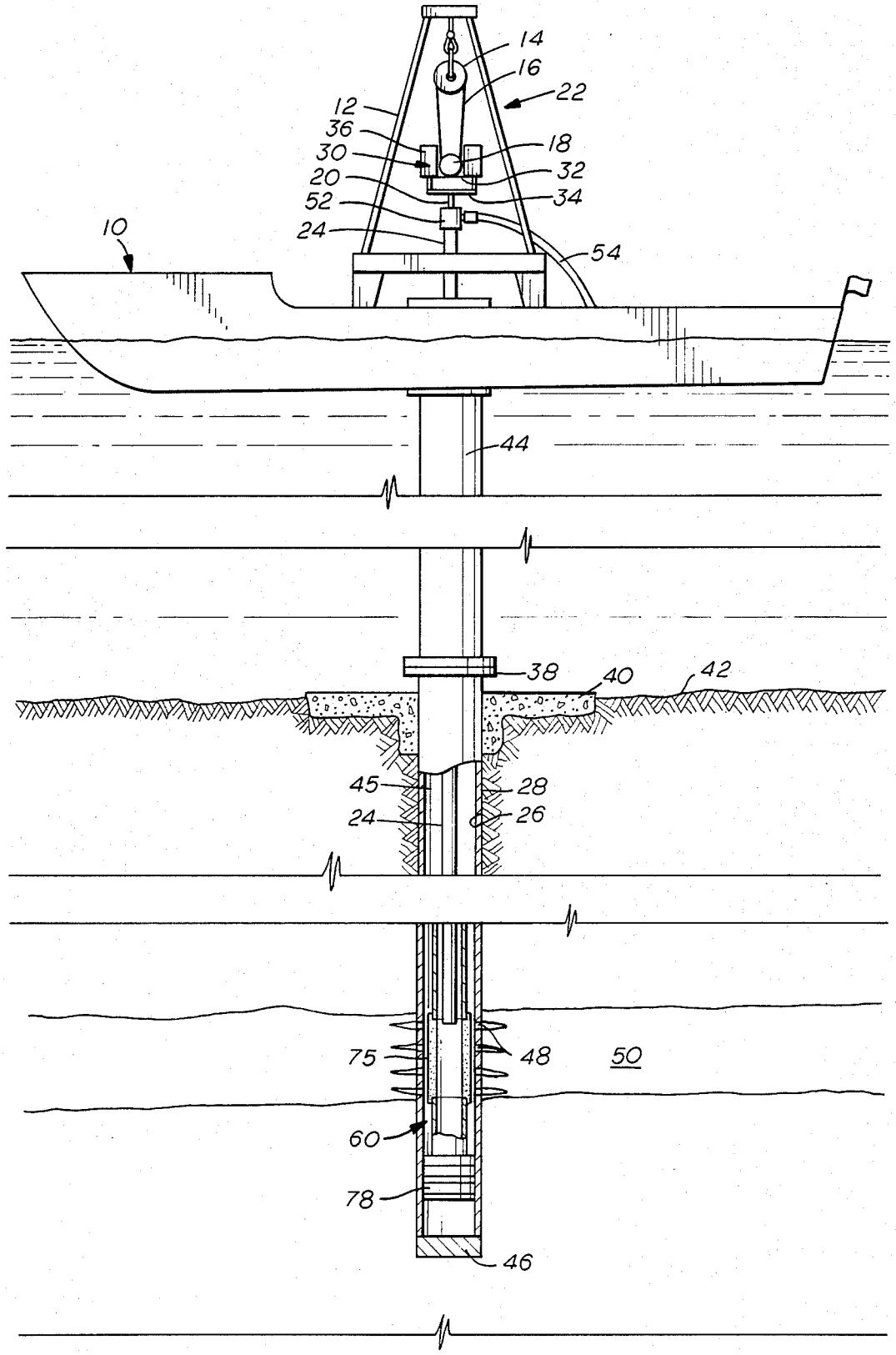
FIG. 1 is a schematic drawing of a drilling vessel showing the environment for a gravel pack system of the present invention for gravel packing an offshore well.

Referring initially to FIG. 1, there is shown a typical offshore well site providing the environment for the utilization of the gravel pack system 60 of the present invention. A floating drilling vessel or ship 10 having a drilling rig 22 which includes a derrick 12 with a crown block 14, cable 16, and travelling block 18. Travelling block 18 suspends a pipe swivel 20. A pipe string 24 is connected to the pipe swivel 20 and is suspended into the earth bore 26.

A motion compensator system 30, such as the Marine Riser and Guideline Tensioner System manufactured by the Vetco subsidiary of Combustion Engineering described at pages 1290–91 of Volume 1 of the 1984–85 *Composite Catalog of Oilfield Equipment and Services* published by Gulf Publishing Company, provides constant tension on pipe string 24 while compensating for the wave-induced vertical motion of floating drilling vessel 10. This system is designed for excessive string weight and/or vessel heave such as are encountered in deep water drilling under adverse conditions. The motion compensator unit 30 consists of an upper yoke 32 attached to the travelling block 18, a lower yoke 34 attached to swivel 20, and hydraulic cylinders 36 therebetween. The hydraulic cylinders 36 provide the compensation for pipe string 24 due to the wave-induced vertical motion of the drilling rig 22.

Well head 38, held in place at the ocean floor 42 by cement 40, suspends well casing 28 within earth bore 26. A marine riser 44 extends from the well head 38 to floating vessel 10. The lower end of casing 28 is plugged and secured within the earth bore by cement 46.

All orientations used in this application are in reference to the well and the gravel pack system as it is placed in operation within the well. The top of the well or up is in the direction of the floating vessel whereas the lower end or down is in the direction of the bottom of the earth bore 26, e.g. cement 46.

Casing 28 is shown extending through production zone 50. Casing 28 has been perforated at 48 adjacent to production zone 50 to allow the flow of production fluids from zone 50 into the interior of casing 28. Although the environment is shown using perforated casing at production zone 50, it can be appreciated that the present invention may be used in an open hole adjacent the formation. The operation is essentially the same in an uncased well.

Gravel pack system 60 is shown schematically in FIG. 1 suspended on the lower end of the pipe string 24 and located adjacent perforated casing 28 and production zone 50. A head connection 52 at the upper end of pipe string 24 is connected to a slurry line 54 for introducing a fluid or slurry into the flow bore of the pipe string 24 for the gravel packing operation.

Figure 2:
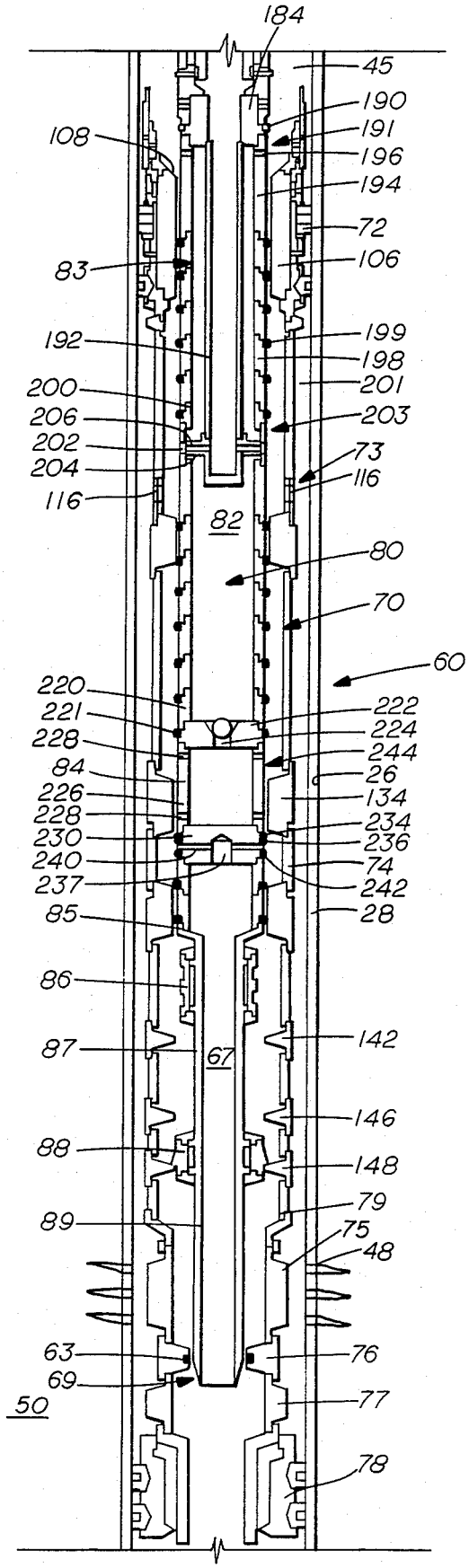
FIG. 2 is a section view of the gravel pack system of the present invention disposed within the well adjacent a producing formation.

Referring now to FIG. 2, the gravel pack system 60 includes a screen assembly 70 and a crossover tool assembly 80 which is received within the screen assembly 70. The screen assembly 70 includes a standard gravel packer 72, a ported sleeve valve 73, a seal bore and interference collar extension assembly 74, a production screen 75, a seal sub 76 which may include an o-ring or seal bore, and a tell tale or tattle tale (a smaller screen) 77 which is optional. A sump packer 78 may be used as hereinafter described to locate the screen assembly 70 adjacent the production zone 50 within the well bore 26. The crossover assembly 80 includes a setting tool (not shown), a crossover tool 83, a circulating valve 84, a shifting collet 86, an indicator collet 88, and a wash pipe 89.

The packer 72 of the screen assembly 70 is adapted for sealing that portion of the annulus 45 above the packer 72 between the pipe string 24, the crossover assembly 80 and the screen assembly 70 and the casing 28 of the well. The production screen 75 is disposed below the packer 72 and positioned adjacent to the producing zone 50. The crossover assembly 80 is lowered on the pipe string 24 and received within the screen assembly 70 until landing on shoulder 108 of assembly 70. Together, the crossover assembly 80 and screen assembly 70 form an upper crossover valve 191, a lower crossover valve 203, a circulation valve 244, and a screen valve 69. Although these valves will be described hereinafter in further detail, a brief description is provided below.

The upper crossover valve 191 opens and closes a flow path between the flow bore 82 of the crossover tool 83 and the annulus 45 above the packer 72. This flow path is formed by the ports 196 in crossover cylinder 194. The upper crossover valve 191 may be closed by seals 190 on mandrel 184 sealingly engaging the seal bore 107 of the packer mandrel 106. The upper crossover valve 191 is always open except during the lower squeeze operation.

The lower crossover valve 203 provides a flow path between the flow bore 27 of the pipe string 24, shown in FIG. 9, and that the annulus 201 formed below the packer 72 between the screen assembly 70 and the casing 28. This flow path is formed by ports 116 in sleeve valve 73 and the ports 206 in tube spacer 204 and the ports 202 in seal spacer 200. The lower crossover valve 203 is closed upon the seals 221 on seal mandrels 220 coming in sealing engagement with the seal bore 107 of the packer mandrel 106. The lower crossover valve 203 is always open except during the reverse circulation operation.

The circulation valve 244 provides a flow path between the flow bore 82 of the crossover tool 83 and that the annulus 201 below the packer 72 between the screen assembly 70 and the casing 28. The flow path of the circulation valve 244 is formed by the flow bore 224 of the check valve 222, the circulating ports 228 in extension 226, the circulating ports 240 in the circulating body 230, and the central passageway 237 in the circulating body 230. The circulation valve 244 is closed by the seals 234, 236, 242 coming in sealing engagement with either the seal bore 134 or the seal bore of the packer mandrel 106. The circulation valve 244 is open except during the upper squeeze and reverse circulation operations.

The screen valve 69 provides a path through the production screen 75 between the flow bore 67 of the wash pipe 89 and that portion of the annulus 201 below the packer 72 between the screen assembly 70 and the casing 28. The screen valve 69 is closed by the seal 63 on the seal sub 76 sealingly engaging the exterior of the wash pipe 89. The screen valve 69 is closed during the lower squeeze and lower circulation operations.

Figure 3:
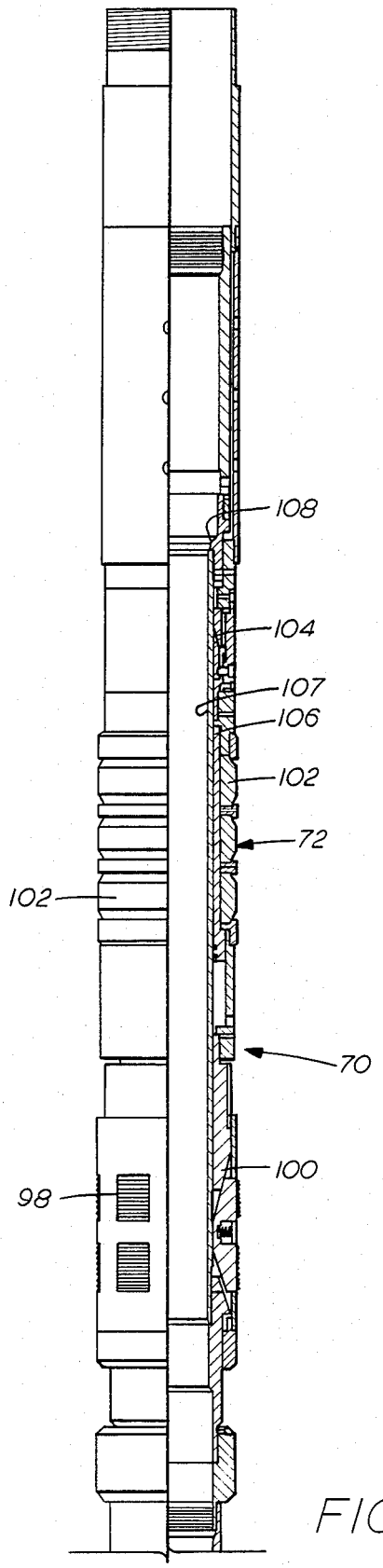
FIGS. 3–5 are partial cross-sections of the screen assembly showing details of the packer, seal bores and interference collars of the gravel pack system of the present invention.

Referring to FIG. 3, the packer 72 of the screen assembly 70 is a standard gravel packer such as the Comp-Set H packer designed and manufactured by Completion Services, Inc. of Lafayette, La. The screen assembly 70 is suspended within casing 28 by packer 72. The packer 72 includes the conventional mechanical slips 98 actuated by cones 100 for engagement with the interior wall of casing 28. Rubber packing elements 102 are set by pressuring down the flow bore 27 of the pipe string 24 whereby rubber packing elements 102 sealingly engage the interior of the casing 28. Lock ring 104 is provided to lock packer 72 in the setting position. Packer mandrel 106 extends the length of the packer 72 and the inner surface of mandrel 106 provides a seal bore 107 for the upper crossover valve 191, lower crossover valve 203 and the circulation valve 244. A landing shoulder 108 is provided on the interior of mandrel 106 for supporting engagement with crossover assembly 80.

Figure 4:
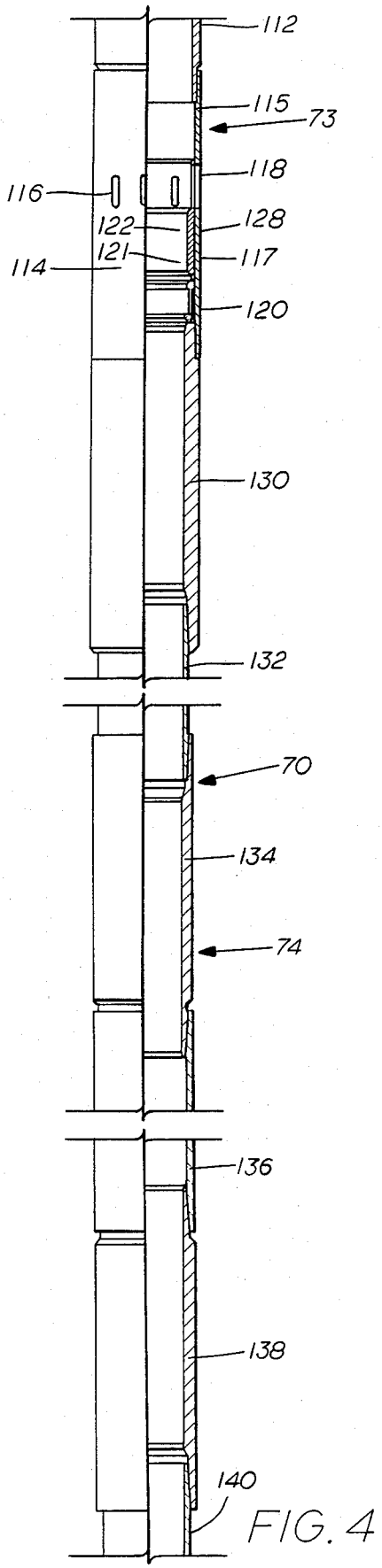

Referring now to FIG. 4, the screen assembly 70 further includes the ported sleeve valve 73 and a seal bore and interference collar extension assembly 74 suspended from the packer 72. The ported sleeve valve 73 includes a tubular extension 112, a slotted perforated extension 114 and a closing sleeve 117. The extension 112 is attached at its upper end to the packer 72 and extends downward for attachment to the slotted perforated extension 114. The slotted perforated extension 114 includes an upper mandrel 115 having a plurality of gravel packing ports 116. The gravel packing ports 116 are spaced around the circumference of mandrel 115 and may be eight in number. Internally of mandrel 115, and slideable therein is the closing sleeve 117. The closing sleeve 117 has a slotted perforated upper portion 118 having the same number of ports positioned opposite the gravel packing ports 116 in the outer mandrel 115. The closing sleeve 117 has an internal shoulder 120 at its lower end. By means of the internal shoulder 120, the closing sleeve 117 may be raised from its open position, as shown in FIG. 4, to a position wherein the lower solid portion 121 of closing sleeve 117 is positioned adjacent the gravel packing ports 116 for the purpose of closing the same. A lock ring 122 may be expanded into a groove in the mandrel 115 to maintain the closing sleeve 117 in the open position, especially when the tool is run into the well.

The ported sleeve valve 73 is attached at its lower end to the top of the seal bore and interference collar extension assembly 74. At the top of the seal bore and interference collar extension assembly 74 is a lower seal bore 130. A seal bore has a smaller internal diameter than the other sections making up the extension assembly 74 and provides a sealing surface for sealing engagement with the seals on the exterior surface of the crossover assembly 80, hereinafter described in greater detail, to provide seals, at predetermined locations, between the screen assembly 70 and the crossover assembly 80. Below seal bore 130 is an extension 132 which extends to an auxiliary seal bore 134. Below auxiliary seal bore 134 is another extension 136 which extends to still another auxiliary seal bore 138.

Figure 5:
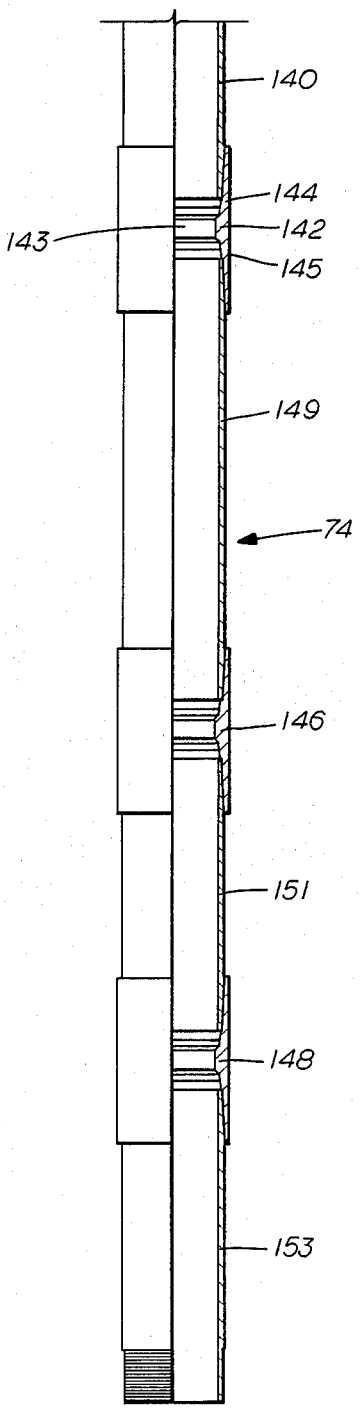

Referring now to FIG. 5, below the seal bores 130, 134, 136, 138 making up the seal bore and interference collar extension assembly 74, are a series of interference collars. The seal bore and interference collar extension assembly 74 includes an extension 140 which, at its upper end, is attached to the lower end of auxiliary seal bore 138 and at its lower end, is attached to the uppermost interference collar 142. The interference collar 142 has a reduced internal diameter portion 143 which forms an upper shoulder 144 and a lower shoulder 145. Below interference collar 142 are interference collars 146 and 148. Each of interference collars 146 and 148 have the same structure as interference collar 142, i.e. a reduced internal diameter portion forming upper and lower shoulders. The interference collars 146 and 148 are connected below interference collar 142 by extensions 149 and 151 respectively. An extension 153 is attached to the lower end of the third interference collar. As shown schematically in FIG. 2, below seal bore and interference collar extension 74 is disposed a shear out safety joint (not shown), several feet of blank pipe or extension pipe 79, a production screen 75, a seal sub 76, a tell tale screen 77 and a sump packer 78. See also FIG. 9. The seal sub 76 includes a seal 63 for sealing engagement with the wash pipe 89. Further details of these have not been set forth since such apparatus is well known to one skilled in the art.

Figure 6A:
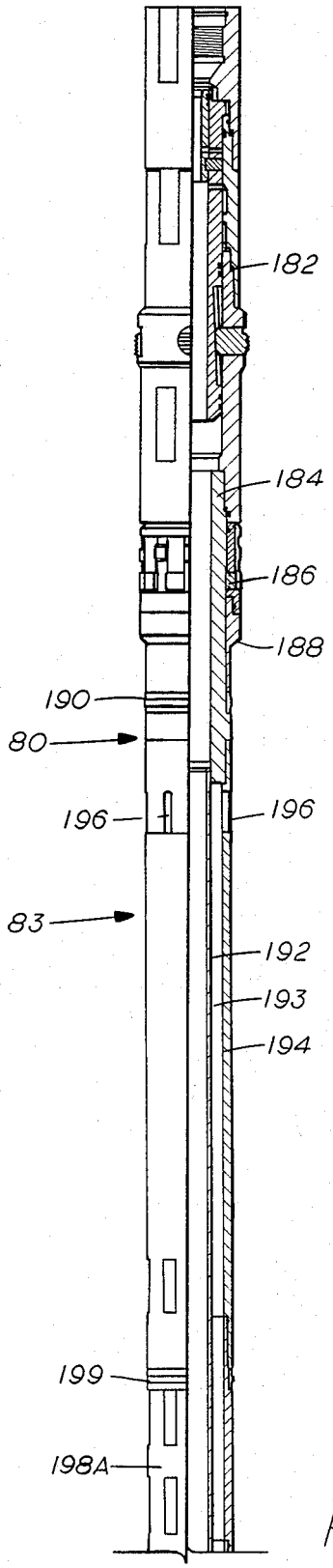
Figure 6B:
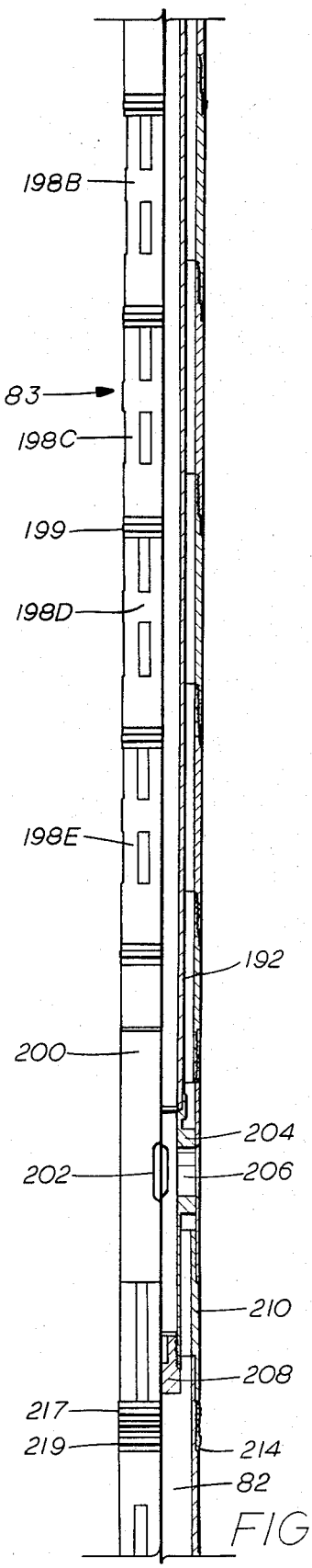

Referring now to FIGS. 6A and 6B, the crossover assembly 80 includes a setting tool (not shown), the crossover tool 83, a circulating valve 84, a shifting collet 86, an indicator collet 88, and a wash pipe 89. The setting tool may be a Comp-Set H setting tool designed and manufactured by Completion Services, Inc. of Lafayette, La. The crossover assembly 80 is disposed internally of the screen assembly 70 and is supported by the landing shoulder 108 of the screen assembly 70 in its initial running-in position. The crossover assembly 80 is attached at its upper end to the pipe string 24.

The crossover tool 83 includes a hydraulic release 182 and a hold down mandrel 184. Holddown mandrel 184 includes an external piston 186. Mandrel 184 also includes an external shoulder 188 for engagement with shoulder 108 of the screen assembly 70. A seal 190 is disposed on mandrel 184 below shoulder 188 for sealing engagement with the screen assembly 70.

The crossover tool 83 also includes an inner pipe or extension tube 192 and an outer pipe or upper crossover cylinder 194. The holddown mandrel 184 has a sealing receptacle for the extension tube 192 and is externally threaded to threadingly receive the upper end of the crossover cylinder 194. The upper crossover cylinder 194 includes a plurality of upper crossover ports 196. The upper crossover ports 196 are at the upper end of the upper crossover cylinder 194 and there may be 4 or 8 such ports spaced around the circumference of the upper crossover cylinder 194. These upper crossover ports 196 permit fluid in the annulus 193 formed between the extension tube 192 and the upper crossover cylinder 194 to pass outwardly through the ports 196. The annulus 93 is a part of the flow bore 82 of the crossover tool 83. The extension tube 192 extends downwardly through a number (five) of seal mandrels 198 making up the crossover tool 83. Each seal mandrel 198 has a seal 199 at its male threaded end. The seal mandrels 198 are an extension of upper crossover cylinder 194. Attached to the lowermost seal mandrel 198E is a seal spacer 200 shown in FIG. 6B, a mandrel which does not have a seal. Seal spacer 200 includes a plurality of lower crossover ports 202. At the lower end of extension tube 192 is a tube spacer 204 which has a plurality of ports 206 that are aligned and in fluid communication with each of the lower crossover ports 202 of seal spacer 200. The lower end of the tube spacer 204 is plugged by plug 208. The plug 208 forces the fluid passing down the extension tube 192 to pass outwardly through aligned ports 206 and 202 externally of the crossover tool 83. Below the seal spacer 200 is a short sub 210 which is attached to the upper end of a double seal mandrel 214 that has double seals 217, 219 around the outer circumference.

Figure 7:
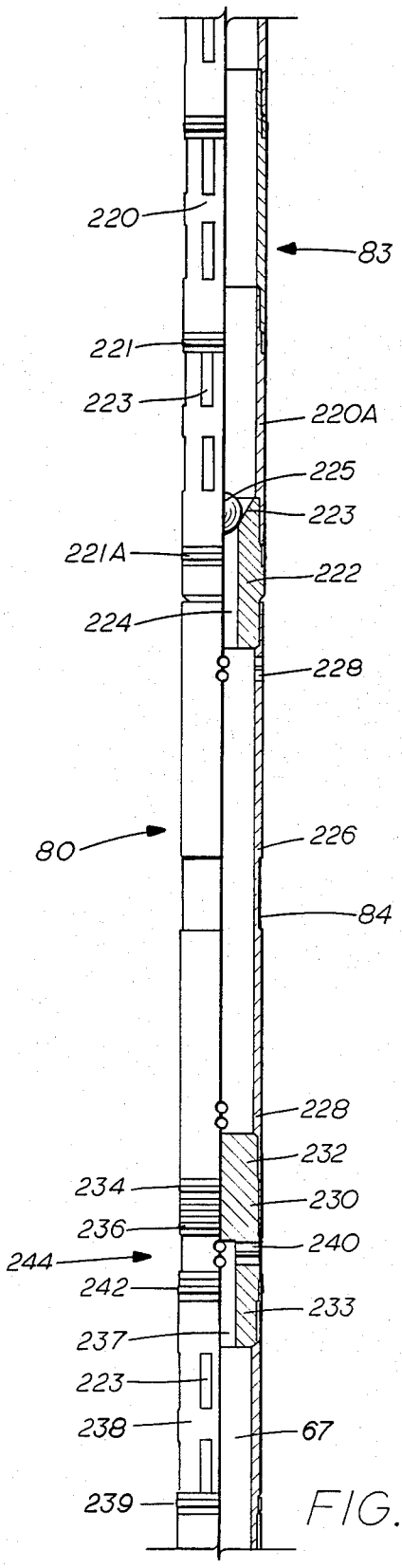

Referring now to FIG. 7, a plurality of seal mandrels 220 with seals 221 are attached to the lower end of double seal mandrel 214. Six seal mandrels 220 connected together extend downwardly to a check valve 222 attached to the lowermost mandrel 220A. The check valve 222 has an inner flow bore 224 with a seat 223 to receive a ball 225 at the upper mouth of bore 224.

Attached to the lower end of the crossover tool 83 is a circulating valve 84. The circulating valve 84 includes an upper extension 226 having symmetrical upper and lower circulating ports 228 located at each end and a circulating body 230 connected to the lower end of extension 226. The circulating body 230 has an upper solid end 232 which is connected to the extension 226. As shown, the threads on the upper end 232 are male threads. Attached to the solid upper end 232, are two seals 234 and 236. The lower end 233 of the circulating body 230, has a central passageway 237 which terminates in a plurality of circulating ports 240 in body 230. Central passageway 237 communicates with the flow bore 67 of the wash pipe 89. The lower end 233 also has male threads. A seal 242 is disposed above these male threads and below the circulating ports 240. When the seals 234 and 236 are in sealing contact with any of the seal bores of the seal bore and interference collar extension assembly 74 of the screen assembly 70, the combined structure acts as a valve 244 in the closed position. When valve 244 is closed, fluid cannot pass upwardly within the passageway 237 and lower flow bore 67 and out of the circulating ports 240. On the other hand, if the seals 234 and 236 are not in contact with a seal bore, valve 244 is open and fluid then can pass upwardly through the lower flow bore 238, passageway 237, and out through circulating ports 240 for flow into circulating ports 228 of extension 226.

Another seal mandrel 222 is attached to the lower end 233 of the circulating body 230. As in the seal mandrels 220 employed above, seal mandrel 238 has a seal 239 at the outer periphery located at its male threaded end. On the outside of seal mandrel 238 are milled flats 223 which are provided for wrenches in making up and disassembling the crossover assembly 80.

Figure 8:
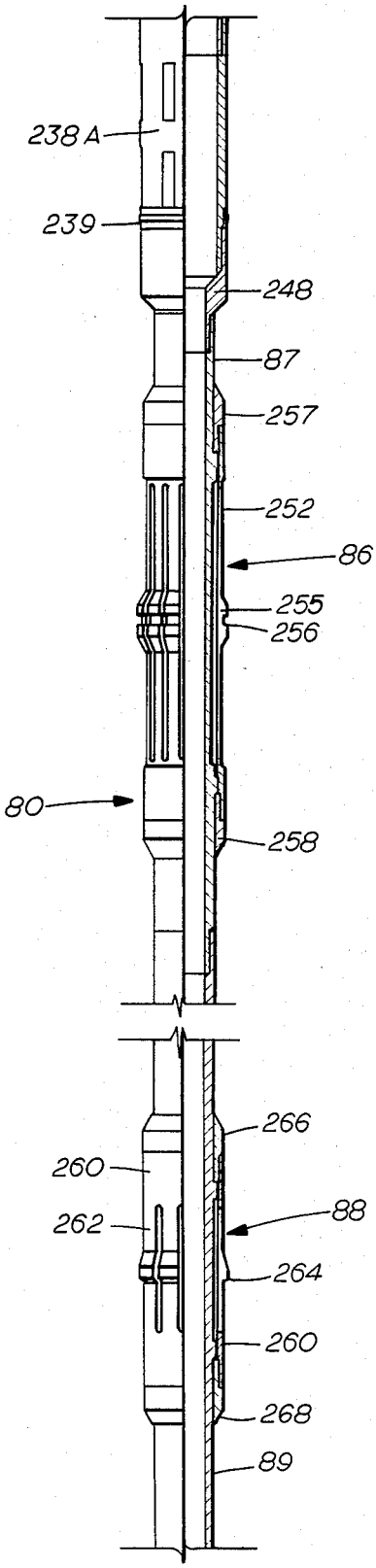
FIGS. 6A, 6B, 7 and 8 are partial cross-sections of the crossover assembly of the gravel pack system of the present invention.

Referring now to FIG. 8, the seal mandrel 238 is attached to an adapter an 248 which reduces the internal diameter of flow bore 67 from that of the seal mandrel 238 to a smaller internal diameter. Attached to the lower end of adapter 248 is a shifting collet mandrel 87. Surrounding the collet mandrel 87, is a shifting collet 86. The shifting collet 86, includes a plurality of spring members 252, each of which have a central body 255 with a groove or notch 256. The spring members 252 are held in place by an upper attaching means 257 and a lower attaching means 258. Each of the spring members 252 is held in place so that body 255 is held away from the surface of the collet mandrel 87. However, when the body 255 comes in contact with one of the seal bores or ported closing sleeve 73 of the screen assembly 70, the body 255 moves inwardly so that the shifting collet 86 easily passes through the seal bores of the seal bore and interference collar extension assembly 74.

The purpose of the shifting collet 86, however, is to close the gravel packing ports 116 of port sleeve valve 73 of the screen assembly 70. This is accomplished as the shifting collet 86 is raised past closing sleeve 117 of sleeve valve 73 and internal shoulder 120 of closing sleeve 117 is joined in groove 256 of the shifting collet 86. This upward movement raises the closing sleeve 117 to close the ports 116 of the sleeve valve 73 and thus close lower crossover valve 203.

Below the shifting collet 86 on the wash pipe 89, is a position indicator collet 88. The indicator collet 88 engages and is supported on one of the interference collars 142, 146, 148 during each of the gravel pack operations. The indicator collet 88 is made up of an outer body 260 having a plurality of openings 262. The body 260 has a supporting shoulder 264 which extends outwardly from the body 260. The body 260 is attached to the wash pipe 89 by an upper attachment 266 and a lower attachment 268. The body 260 is sufficiently strong to withstand a predetermined tension before the body 260 will move inwardly to pass through one of the interference collars 142, 146, 148 and after having passed through one of the interference collars, can be seated on that interference collar with shoulder 264 of indicator collet 88 seated on upper shoulder 144 of one of the interference collars 142, 146 or 148, respectively. The force required to raise the crossover assembly 80 so as to cause the indicator collet 88 to pass through one of the interference collars 192, 146, 148 provides a positive indication that the crossover assembly 80 has been raised to the new position for the next gravel pack operation.

In carrying out a gravel packing operation with this assemblage of structure, the screen assembly 70 is assembled before running into the well. If the sump packer 78 is used, the sump packer 78 is lowered into the casing 28 and set by a wire line in its conventional and known manner. The sump packer 78 may provide the seat for all other components of the gravel pack system 60 when the crossover assembly 80 is placed within the screen assembly 70 and the assembled system 60 is lowered into the well. The packer 72 is set by introducing fluid into the flow bore 27 of the pipe string 24 and increasing the pressure to the predetermined level to set packer 72. The pressure in the pipe string 24 activates the setting tool and forces the cones 100 of the packer 72 downward thus moving the mechanical slips 98 into contact with the casing 28. The packer 72 and the sump packer 78 are set within the casing 28 to position the production screen 75 so that approximately five feet of production screen 75 extends above and below the production zone 50.

FIGS. 9 through 14 illustrate the operations of the gravel pack system 60 to perform the steps of the typical gravel pack including running in, lower squeeze, lower circulation, upper squeeze, upper circulation, reverse circulation, and preparation for production installation. Each of these steps is shown in FIGS. 9–14, respectively.

Figure 9:
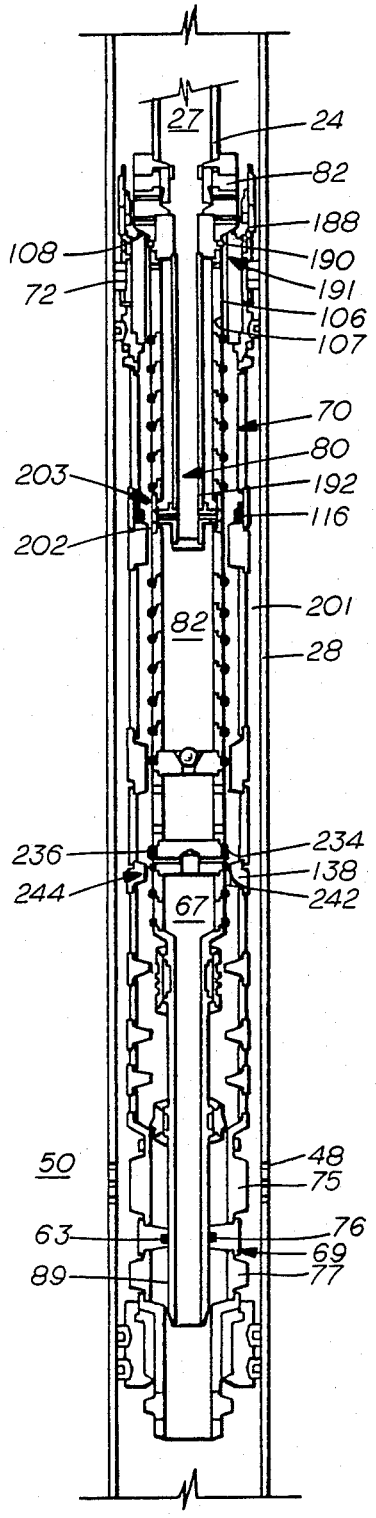
FIG. 9 is a sectional view showing the gravel pack system of the present invention with the crossover assembly in the running-in position of the all up gravel pack system and lower squeeze position.

FIG. 9 illustrates the gravel pack system 60 in the running-in and lower squeeze position. The production screen 75 is positioned in the casing 28 adjacent the production zone 50 and the perforations 48. The packer 72 of the screen assembly 70 is set positioning the crossover assembly 80 in its lowermost position within the screen assembly 70. The crossover assembly 80 is supported by the screen assembly 70 due to the shoulder 188 of the crossover tool 83 being in contact with the landing shoulder 108 of packer 72.

FIG. 9 also illustrates the position of the gravel pack system 60 for carrying out a lower squeeze operation. In this position, a fluid, either water or oil, is introduced into the flow bore 27 of the pipe string 24 and into the extension tube 192 of the crossover tool 83. The lower crossover valve 203 is open. The fluid passes downwardly and out of lower crossover ports 202, 206 and through the gravel packing ports 116 into the annulus 201 formed between the screen assembly 70 and the casing 28. The fluid passes downwardly in annulus 201 and out the perforations 48 into the producing zone 50. Some fluid will pass through the tell tale screen 77 and up through the flow bore 67 of wash pipe 89. This fluid will pass through the circulation valve 244 since seal 234 is not in sealing contact with the seal bore 138, the circulation valve 244 being in the open position. The fluid will flow up the flow bore 82 of the crossover tool 83 until it reaches the upper crossover valve 191 which is closed because seal 190 is in sealing engagement with the seal bore 107 of packer mandrel 106. The lower squeeze operation therefore permits the fluid to flow at a predetermined pressure and is forced out into the formation 50 to establish an injection rate of the fluid into the formation 50. The screen valve 69 is closed with the wash pipe 89 being in sealing engagement with the seal 63 of seal sub 76. This insures that the slurry does not flow through the production screen 75.

Figure 10:
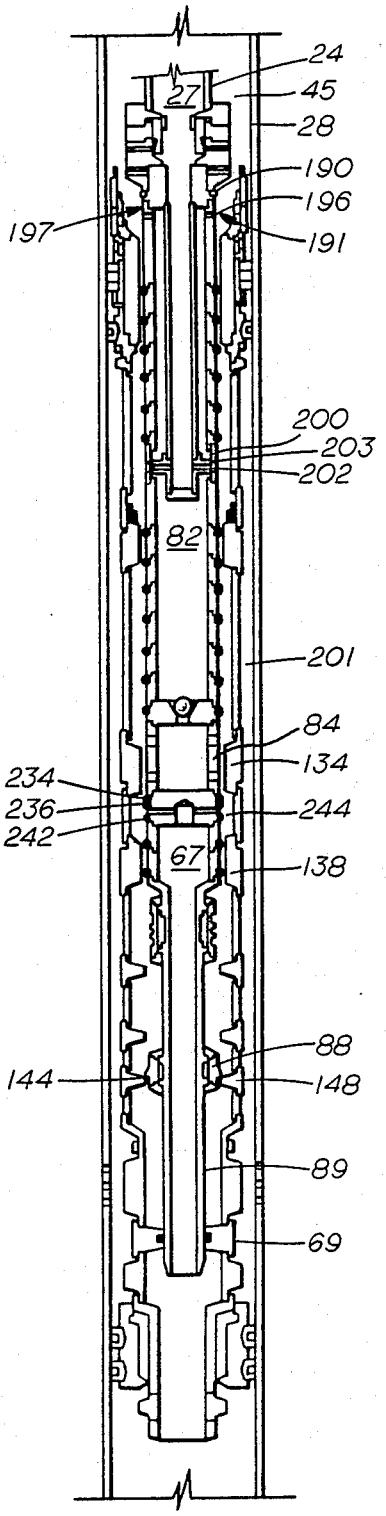
FIG. 10 is a sectional view showing the crossover assembly raised to the lower circulating position.

After the lower squeeze operation has been achieved, the crossover assembly 80 is raised within the screen assembly 70 to the lower circulating position shown in FIG. 10. As shown in FIG. 10, in raising crossover assembly 80, the indicator collet 88 passed through interference collar 148 and is seated on the upper shoulder 144 thereof. A definite indication of the positioning of the crossover assembly 80 can be determined since to pull the indicator collet 88 through the interference collar 148 requires a predetermined force, for example 15,000 pounds. Once the indicator collet 88 passes through the interference collar 148, the tension on the pipe string 24 is immediately reduced and then a downward predetermined weight, for example 10,000 pounds, is placed on the pipe string 24 so that the crossover assembly 80 seats on the interference collar 148 thereby definitely positioning the crossover assembly 80 within the screen assembly 70.

The collet arrangement permits the gravel pack system 60 to lock in at different tool positions. Collets can be designed to be pulled through the interference collars at various weights. For this arrangement, the collet is designed for 15,000 pounds. This means that it requires at least 15,000 pounds for the body of the collet 88 to be moved inward to pass through an interference collar. When 10,000 pounds is used to set the collet 88 on an interference collar, this would permit a 5,000 pound differential in weight due to rig movement. The compensator 30 will permit only a 1,000 to 2,000 pound swing. Accordingly, with the collets and compensator, the heaving and movement of the rig makes certain of the positioning of the system 60 in the well. It is understood of course that the design of the respective weights can be varied and still achieve a suitable gravel pack system 60. Further it can be appreciated that there could be a plurality of indicator collets on crossover assembly 80 with only one interference collar on the screen assembly 708 to accomplish the same objective.

Referring now to FIG. 10, the crossover assembly 80 is positioned for the lower circulation operation. In this position, the upper crossover valve 191, lower crossover valve 203 and the circulation valve 244 are open. The screen valve 69 is closed. The circulation valve 244 is open since the seals 234, 236, and 242 are not in engagement with a seal bore. Furthermore, the upper crossover valve 191, formed by seal 190 of hold down mandrel 184 and the mandrel seal bore 107 of packer 72, is now open since the seal 190, above the upper crossover port 196, is now located above the mandrel 106 of the packer 72 and is no longer in sealing engagement with the mandrel seal bore 107. With both upper crossover valve 191 and lower crossover valve 244 open, fluid can now pass up through the flow bore 67 of wash pipe 89, around the circulating valve 84 and into the flow bore 82 of crossover tool 83 for flow through upper crossover valve 191 into the annulus 45 between the pipe string 24 and the casing 28.

A slurry of gravel is introduced through the pipe string 24 and lower crossover valve 203 to begin the lower circulation operation. Continuing to introduce the slurry of gravel, buildup of the gravel within the annulus 201 between the screen assembly 70 and the casing 28 occurs with the passage of the fluid up the wash pipe 89 for return to the floating vessel 10 by passing in the annulus 45 between the pipe string 24 and the casing 28. After a certain amount of slurry is introduced and an increased pressure in pumping the slurry is encountered, then the circulation operation is stopped completing the lower circulation operation.

Figure 11:
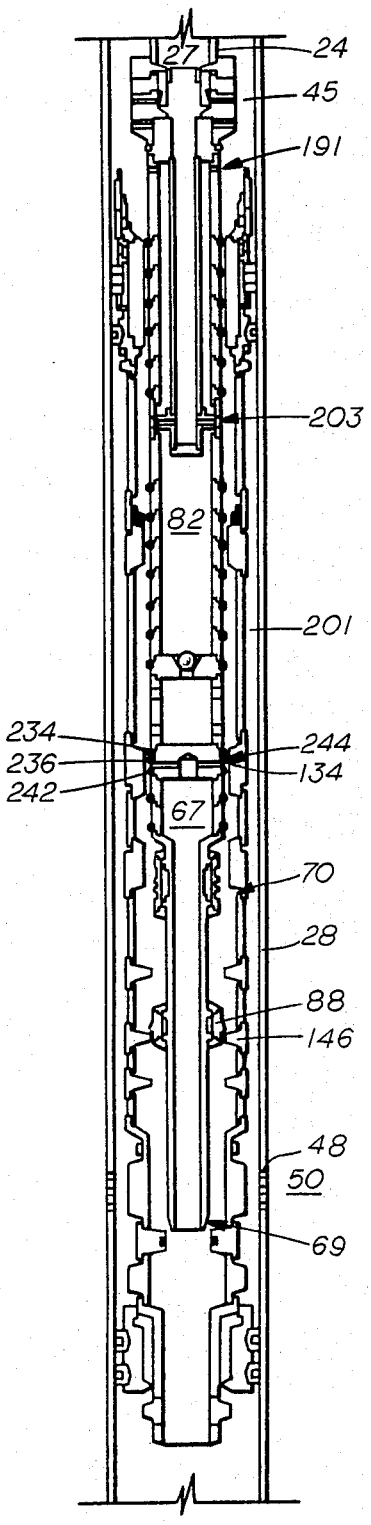
FIG. 11 is a sectional view with the crossover assembly raised within the screen assembly for carrying out an upper squeeze operation.

The crossover assembly 80 is then raised so that the indicator collet 88 is passed through and seated on interference collar 146 as shown in FIG. 11 in preparation for an upper squeeze operation. In this position, upper crossover valve 191, lower crossover valve 203 and screen valve 69 are open and circulation valve 244 is closed since seals 234, 236 and 242 are in sealing engagement with seal bore 134. Fluid is introduced through the flow bore 27 of the pipe string 24 and lower crossover valve 203 so as to force the slurry into the annulus 201 between assembly 70 and casing 28 out the perforations 48 into the formation 50. The flow rate of the slurry will become reduced as the gravel pack is formed in the formation 50. As the back pressure builds, the operation is completed and the pumping of fluid is stopped.

Figure 12:
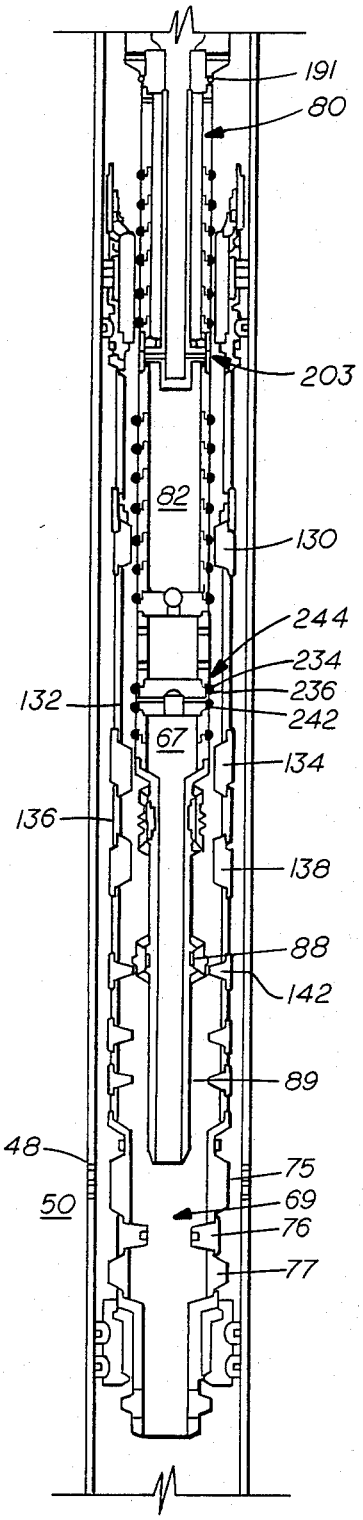
FIG. 12 is a sectional view with the crossover assembly raised still further within the screen assembly to an upper circulating position.

The crossover assembly 80 is then raised so that the indicator collet 88 is passed through and set on interference collar 142 as shown in FIG. 12. In this position, all valves 69, 244, 203, 191 are open and an upper circulation of slurry takes place. The slurry again is introduced into the pipe string 24. However, in this position, the screen valve 69 is open since the wash pipe 89 is above the seal sub 76 so that the fluid not only flows through the tell tale screen 77, but through the production screen 75 to the flow bore 67 of the wash pipe 89 and up the flow bore 82 of the crossover tool 83 to the annulus 45. Especially when the production zone 50 is fairly long, this assures packing at the top of the zone so that there is a complete gravel pack over the entire depth of the producing zone 50.

Figure 13:
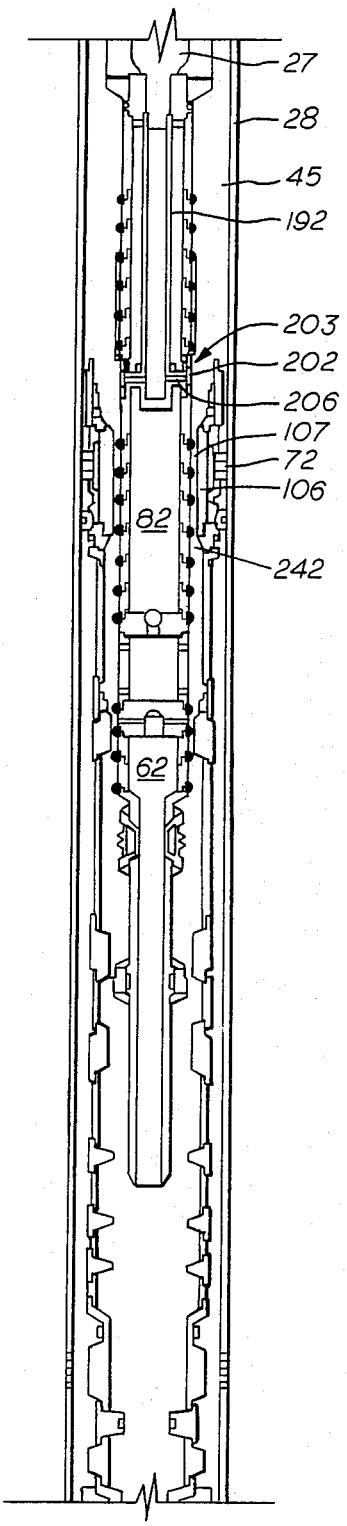
FIG. 13 is a schematic drawing with the crossover assembly raised within the screen assembly to a position for reverse circulation.
Figure 14:
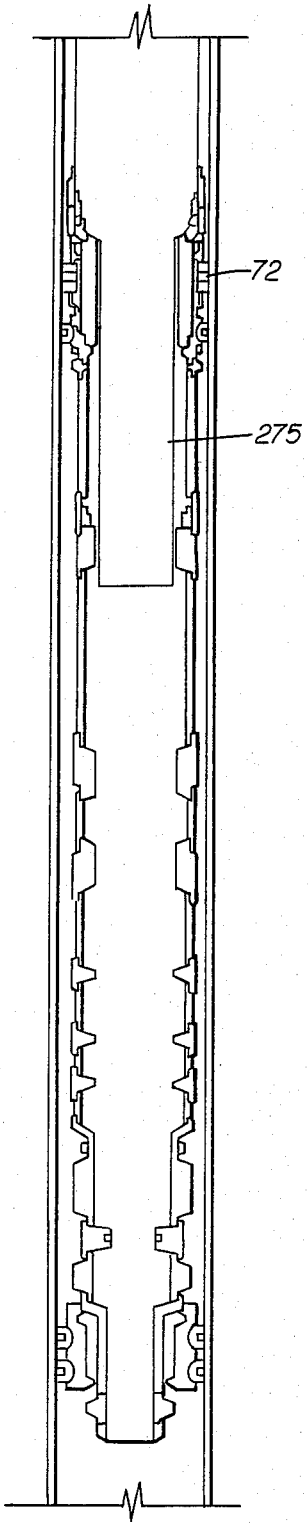
FIG. 14 is a schematic drawing wherein the crossover assembly is entirely removed from the screen assembly and a production member is placed in the screen assembly for production.

Referring now to FIG. 13, after completion of the circulation of the slurry to form the gravel pack, the crossover assembly 80 is again raised for reverse circulation. The reverse circulation permits recirculation to remove the gravel slurry from the pipe string 24. The lower crossover valve 203 is open permitting direct flow from the annulus 45 to the flow bore 27 of the pipe string 24. The circulation valve 244 is closed. The only seal required is for the seal bore 107 of mandrel 106 of packer 72 to be sealed by one of the seals 221 on seal mandrels 220. The reverse circulation is now carried out by pumping fluid down the annulus 45 (the reverse of normal) between the pipe string 24 and casing 28 where the fluid, either water or oil, will pass through lower crossover valve 203, i.e., lower crossover ports 202 and the ports 206 in the extension pipe 192 for recirculation to the floating vessel 10.

Thereafter, the crossover assembly 80 may be completely removed. To make certain that the perforations and ports are closed, a production seal assembly 275, shown in FIG. 14, may be run and seated on the packer 72.

As illustrated in FIG. 9 through FIG. 14, the typical gravel pack includes a lower squeeze, a lower circulation, an upper squeeze, an upper circulation and then reverse circulation prior to production. Alternatively, it may be desired to have a squeeze operation followed by a lower circulation operation (meaning that there is no flow of fluid through the production screen but only the tell tale screen) followed by an upper circulation operation (flow through both production screen and tell tale screen) and then a squeeze operation. The present system easily permits such a sequence of operations by the simple interchange of the extensions between the seal bores 130 and 134 and the seal bores 134 and 138. As is shown in FIG. 12, the extension 136 between the two seal bores 134 and 138 is relatively short. On the other hand, the extension 132 between the upper seal bore 130 and seal bore 134 is relatively long. If the length of these two extensions are interchanged, the seal bore 134 is raised to a position such that seals 234, 236 and 242 are in sealing contact therewith. With the system in that configuration, rather than the circulation valve 244 being closed as shown in FIG. 11, the circulation valve 244 will be opened permitting an upper circulation with the wash pipe 89 above the seal sub 76. After being raised to the position shown in FIG. 12, however, the circulation valve 244 would be closed thus changing the operational sequence.

The detailed method of the present invention includes the following steps:

(1) Preparation of the well as in a conventional gravel pack procedure.

(2) Run in the hole a sump packer and set on a wire line.

(3) Run in a hole a screen assembly comprising of seals into sump packer, tattletale, seal bore sub, production screen, blank tubing, safety shear sub (if needed), extended interference collar assembly, extended lower seal bore extension, lower seal bore, extended slotted extension, and Comp-set H packer.

(4) Make-up extended crossover/setting tool to screen assembly.

(5) Run in the entire assembly into the hole and sting the assembly into the sump packer.

(6) Place a minimum of 25,000 pounds of weight on the sump packer and set the compensator to accommodate for rig movement.

(7) Drop a steel ball into the hole and set the packer in a standard manner.

(8) Place a minimum of 20,000 pounds of weight on the tool. Pressure test the packer with casing pressure. From this squeeze position, establish the injection rate into the formation.

(9) Pressure up on the annulus to 500 psi. From the squeeze position, pull up the string until pressure on the annulus bleeds off which will occur at approximately eleven feet. Pull up an additional two feet to assure that the crossover port is out of the packer. An additional six feet of upper travel from this point will remove the last seal from the packer bore. Set the compensator for total pipe weight.

(10) Circulate down acid to within two barrels of the crossover assembly.

(11) Slack off into the lower squeeze position. Set down 10,000 pounds and set the compensator. Close the annulus and pressure up on the annulus to 1,000 psi.

(12) Squeeze the acid into the formation and displace with completion fluid.

(13) Once acid has been squeezed away, prepare for gravel packing.

(14) Reposition the tool in the reverse position and circulate the slurry to within two barrels of the crossover assembly.

(15) To establish lower circulating position, first slack off into the squeeze position. Pull up eight to twelve inches to pull through the first interference collar. Then place 10,000 pounds of weight on the interference collar.

(16) Continue pumping slurry until a pressure increase indicates that the tattletale is covered and returns diminish.

(17) Pull up thirty inches through the second interference collar and set down 10,000 pounds of weight to establish the upper squeeze position. Place 500 to 1,000 psi pressure on the annulus and pressure up to 1,500 psi over the injection pressure on pack through the pipe string.

(18) Blend off all pressure and pull up thirty-two inches through the third interference collar and set down 10,000 pounds to establish the upper circulating position. Continue pumping to dehydrate the slurry across the production screen. Pressure the annulus to 500 psi over the pipe string pressure.

(19) To reverse out, pull up until pressure bleeds down on the annulus. Pull up an additional two feet and begin to reverse out any slurry left in the pipe string. An additional six feet of upper travel from this point will remove the last seal from the packer seal. Reverse two tubing volumes.

(20) Reposition the tool in the upper squeeze position and test the pack. If the pack does not test, repeat gravel pack with one-half slurry volumes.

(21) Pull out of the hole with the crossover assembly. If a closing gravel pack collet is used, the sleeve valve will close at this time.

(22) Go in the hole with a production assembly and sting into the Comp-Set H packer.

(23) Continue the procedure to place well on production.

In order to have no appreciable downward movement of the crossover assembly during a gravel pack, the operation of the present invention is an all up positioning operation.

In order to lower the drill pipe on a drilling string which uses a motion compensator, the pressure to the compensator must first be bled off. This procedure takes time and may cause bridging problems during the gravel packing operation. The present invention requires only upward movement and, therefore, the compensators do not need to have the pressure relieved during the entire gravel packing operation.

The method of the present invention has the advantage of providing a positive indication for all positions. No surface measurements are required to move the crossover tool from position to position This can simplify the operation because the floating rig floor makes it very difficult to move the pipe string a specified distance While a preferred embodiment of the invention has been shown and described, modifications thereof can be made by one skilled in the art without departing from the spirit of the invention. For example, the upper crossover valve 191 may be combined with the circulation valve 244. The seals 190 on mandrel 184 may be eliminated such that the ports 196 in crossover cylinder 194 remain open throughout the gravel pack operation. The circulation valve is repositioned on crossover assembly 80 so that the seals 234, 236 are in sealing engagement with the seal bore 134 to close the circulation valve 244 during the lower squeeze operation. Thus, the circulation valve 244 controls flow through the ports 196

Another modification to the present invention includes the elimination of the screen valve 69. In such an alternative, the gravel pack system includes only one circulating position. The o-ring sub 76 is removed and the washpipe 89 is extended such that its lower end is adjacent the lower end of tell tale screen 77, or if tell tale screen 77 is not used, the lower end of production screen 75. By so positioning the washpipe 89 and by increasing the diameter of the washpipe 89 so as to reduce the annulus formed between the washpipe 89 and screen assembly 70, the fluid flowing down the annulus 201 around the screen assembly 70 will flow towards the least resistance to flow. The path of least resistance includes fluid flow to the lower end of the screens, because of the large annulus 201 between the screen assembly 70 and casing 28, and into the lower end of the washpipe 89 rather than the annular space around washpipe 89. Thus the present invention could be used without the screen valve 69 to utilize one circulating position

We claim:

1. A gravel pack system for gravel packing a formation, which comprises:

a screen assembly;

a crossover assembly within said screen assembly, said screen assembly and crossover assembly forming interference collar and indicator collet means for positioning said crossover assembly within said screen assembly;

said screen assembly comprising:

a packer for setting and sealing said screen assembly within said well, a ported extension below said packer, a portion of said interference collar and indicator collet means disposed below said ported extension, and a production screen below said portion of said interference collar and indicator collet means;

said crossover assembly comprising:

a crossover means having an extension tube and outer cylinder for passing fluid downwardly through said extension tube to a lower port and outside said crossover assembly and for passing fluid upwardly through said outer cylinder to an upper port, a wash pipe section, another portion of said interference collar and indicator collet means disposed on said section, and a circulating valve, said circulating valve positioned between said outer cylinder and said wash pipe section for controlling passage of fluid from said wash pipe upwardly to said outer cylinder and upper port;

said crossover assembly having a plurality of positions within said screen assembly including a lower circulating position for passing a gravel slurry through said extension tube and lower port and into the formation and returning fluid through said wash pipe section, outer cylinder and upper port, an upper squeeze position for passing a gravel slurry through said extension tube and lower port and forcing the gravel slurry into the formation by closing said circulation valve, and an upper circulating position for passing a gravel slurry through said extension tube and lower port and into the formation and returning fluid through said wash pipe section, outer cylinder and upper port;

said interference collar and collet means positioning said crossover assembly within said screen assembly for each of said lower circulating, upper squeeze and upper circulating positions.

2. A gravel pack system according to claim 1 wherein said screen assembly further includes:

a seal sub below said production screen, and a tattletale screen below said seal sub.

3. A gravel pack system according to claim 2 wherein said screen assembly further includes:

a sump packer at the bottom of said screen assembly.

4. A gravel pack system according to claim 1 wherein said circulating valve includes:

means for passage of fluid from inside said valve to outside said valve and back into the inside of said valve.

5. A gravel pack system according to claim 1 wherein said circulating valve includes:

a tubular extension having ports; and a circulating body having seal means circumferentially around the outside of said valve.

6. The gravel pack system of claim 1 wherein said another portion of said interference collar and indicator collet means interferes with said portion of said interference collar and indicator collet means as said crossover assembly is positioned within said screen assembly to form said lower circulating, upper squeeze, and upper circulating positions.

7. The gravel pack system of claim 6 wherein one of said portions of said interference collar and indicator collet means is seated on the other of said portions at each of said lower circulating, upper squeeze, and upper circulating positions.

8. The gravel pack system of claim 6 wherein said portions of said interference collar and indicator means interfere a predetermined amount causing a predetermined amount of force to position said crossover assembly within said screen assembly.

9. A screen assembly for a gravel pack system within a well which comprises:

a packer for setting and sealing said packer within a well, a ported extension disposed below said packer, a production screen disposed below said ported extension;

a seal bore and interference collar means disposed below said ported extension and above said production screen, said seal bore and interference collar means having a plurality of seal bores and a plurality of interference collars, said interference collars disposed between said seal bores and said production screen.

10. A screen assembly according to claim 9 which further includes:

a seal sub below said production screen, and a tell tale screen below said seal sub.

11. A screen assembly according to claim 10 which further includes:

a sump packer at the bottom of said assembly.

12. A method for gravel packing a formation in a well which comprises:

running a screen assembly having a packer, crossover tool, and production screen into the wall and setting the packer above the formation to form an annulus adjacent the formation;

sequentially raising the crossover tool to perform the steps of lower squeeze opening the flow of gravel to the annulus and formation and closing the production screen and the flow of returns to the surface;

lower circulation opening the flow of gravel to the annulus and formation, maintaining the production screen closed, and opening the flow of returns to the surface;

upper squeeze opening the flow of gravel to the annulus and formation and through the production screen and closing the flow of returns to the surface;

upper circulation opening the flow of gravel to the annulus and formation and opening the production screen for flow of the returns to the surface; and reverse circulation closing the annulus and opening the crossover tool for the reverse flow of fluid to the surface.

13. A gravel pack system for gravel packing a formation in a well, comprising:

a screen assembly including a packer adapted for sealing the annulus between said assembly and the wall above the formation and a screen disposed on said packer adapted for positioning adjacent the formation;

a crossover assembly reciprocally received within said screen assembly and adapted for suspension within the well on a pipe string, said crossover assembly having a first flow bore;

said crossover assembly and screen assembly forming an upper crossover valve, a lower crossover valve, a circulation valve, and a screen valve;

said upper crossover valve opening and closing a first flow path between said first flow bore and the upper annulus above said packer;

said lower crossover valve opening and closing a second flow path between a second flow bore of the pipe string and the lower annulus below said packer;

said circulation valve opening and closing a second flow path through said first flow bore;

said screen valve opening and closing a third flow path through said screen between said first flow bore and the lower annulus below said packer;

said crossover assembly having a lower circulating position within said screen assembly for passing a gravel slurry through said second flow path and into the formation and returning fluid through said first flow path, an upper squeeze position within said screen assembly for closing fluid flow to the surface through said first flow path and forcing the gravel slurry through said second flow path and into the formation, and an upper circulating position within said screen assembly for passing gravel slurry through said second flow path and into the formation and returning fluid through said third and first flow paths;

said crossover assembly selectively opening and closing said valves and being positioned within said screen assembly for said lower circulating, upper squeeze, and upper circulating positions upon only an upward movement of said crossover assembly within said screen assembly.

14. The gravel pack system of claim 13 wherein said crossover assembly includes a wash pipe extending below said circulation valve and further including positioning means for positioning said crossover assembly within said screen assembly to selectively actuate said upper crossover valve, lower crossover valve, circulation valve, and screen valve.

15. The gravel pack system of claim 14 wherein said positioning means includes interference means disposed on said assemblies for causing interference between said assemblies as said crossover assembly is raised within said screen assembly.

16. The gravel pack system of claim 15 wherein said interference means includes a plurality of interference collars disposed on said screen assembly and at least one indicator collet disposed on said crossover assembly; said indicator collet interfering with at least one of said interference collars as said crossover assembly is raised within said screen assembly.

17. The gravel pack system of claim 16 wherein said indicator collet contracts to pass through said one of said interference collars and expands after passing through said one of said interference collars.

18. The gravel pack system of claim 17 wherein said one of said interference collars supportingly engages said indicator collet after having passed therethrough to support said crossover assembly within said screen assembly.

19. The gravel pack system of claim 14 wherein said positioning means includes support means for supporting said crossover assembly within said screen assembly upon achieving the desired position.

20. The gravel pack system of claim 14 further including means for positioning said crossover assembly within said screen assembly at a lower squeeze position, whereby said upper crossover valve is closed, said lower crossover valve is open, said circulation valve is open, and said screen valve is closed such that fluid may pass down the pipe string, through said lower crossover valve, into said lower portion of the annulus between said screen assembly and casing below said packer and into the formation.

21. The gravel pack system of claim 14 further including means for positioning said crossover assembly within said screen assembly at said lower circulating position, whereby said upper crossover valve and lower crossover valve and circulation valve are open and said screen valve is closed such that slurry may pass down through the pipe string, through said lower crossover valve, into said lower portion of the annulus between said screen assembly and casing, up the flow bore of said wash pipe to the annulus between said pipe string and said casing above said packer.

22. The gravel pack system of claim 14 further including means for positioning said crossover assembly within said screen assembly at said upper squeeze position, whereby said lower crossover valve is open and said circulation valve is closed such that said fluid may pass down the pipe string, through said lower crossover valve, into that portion of the annulus between said screen assembly and said casing below, said packer and into the formation.

23. The gravel pack system of claim 14 further including means for positioning said crossover assembly within said screen assembly at said upper circulating position, whereby said upper crossover valve, lower crossover valve screen valve, and circulation valve are open such that slurry may pass down through the pipe string, through said lower crossover valve, into that portion of the annulus between said screen assembly and said casing below said packer, up the flow bore of said wash pipe to the annulus between said pipe string and said casing above said packer.

24. The gravel pack system of claim 14 further including means for positioning said crossover assembly within said screen assembly at a reverse circulation position;

a seal on said crossover assembly is in sealing engagement with the seal bore of said packer for flow of fluid down the annulus between said pipe string and said casing and through lower crossover valve ports of said crossover assembly for flow of fluid up said pipe string.

25. The gravel pack system of claim 13 wherein said upper crossover valve includes a seal disposed on said crossover assembly positioned for sealing engagement with a seal bore on said packer at a predetermined position between said assemblies.

26. The gravel pack system of claim 13 wherein said lower crossover valve includes a plurality of seals on said crossover assembly alignable with one or more of a plurality of seal bores in said screen assembly.

27. The gravel pack system of claim 13 wherein said circulation valve includes crossover ports in said crossover assembly and ports in said screen assembly.

28. The gravel pack system of claim 13 wherein said screen valve includes a seal sub disposed on said production screen of said screen assembly for sealing engagement with the end of said wash pipe.

29. The gravel pack system of claim 13 wherein said screen valve includes a seal disposed on said washpipe for sealing engagement with a seal bore sub disposed on said screen assembly.

30. A gravel pack system for gravel packing a formation in a well, comprising:

a screen assembly including a packer adapted for sealing the annulus between said assembly and the well above the formation and a screen disposed on said packer adapted for positioning adjacent the formation;

a crossover assembly reciprocally received within said screen assembly and adapted for suspension within the well on a pipe string, said crossover assembly having a flow bore;

said crossover assembly sand screen assembly forming a crossover valve and a circulation valve;

said crossover valve opening and closing a first flow path between the bore of the pipe string and the annulus below said packer;

said circulation valve opening and closing a second flow path from the annulus above said packer, through said flow bore to the annulus below said packer;

said crossover assembly having a lower circulating position within said screen assembly for passing a gravel slurry through said first flow path and into the formation and returning fluid through said second flow path, an upper squeeze position within said screen assembly for closing fluid flow through said second flow path to the surface and forcing the gravel slurry through said first flow path and into the formation, and an upper circulating position within said screen assembly for passing gravel slurry through said first flow path and into the formation and returning fluid through said second flow path;

said crossover assembly selectively opening and closing said valves and being positioned within said screen assembly for said lower circulating, upper squeeze, and upper circulating positions upon only an upward movement of said crossover assembly within said screen assembly.

31. The gravel pack system of claim 30 wherein said crossover assembly includes a wash pipe extending below said circulation valve and further including positioning means for position said crossover assembly within said screen assembly to selectively actuate said crossover valve and circulation valve.

32. The gravel pack system of claim 30 further including means for positioning said crossover assembly within said screen assembly at a lower squeeze position, whereby said crossover valve is open and said circulation valve is closed, such that fluid may pass down the pipe string, through said crossover valve, into the annulus between said screen assembly and casing below said packer and into the formation.

33. The gravel pack system of claim 30 further including means for positioning said crossover assembly within said screen assembly at said lower circulating position, whereby said crossover valve and circulation valve are open such that slurry may pass down through the pipe string, through said crossover valve, into the annulus between said screen assembly and casing below said packer, up the flow bore of said wash pipe to the annulus between said pipe string and said casing above said packer.

34. The gravel pack system of claim 30 further including means for positioning said crossover assembly within said screen assembly at said upper squeeze position, whereby said crossover valve is open and said circulation valve is closed such that said fluid may pass down the pipe string, through said crossover valve, into that portion of the annulus between said screen assembly and said casing below said packer and into the formation.

35. The gravel pack system of claim 30 further including means for positioning said crossover assembly within said screen assembly at said upper circulating position, whereby said crossover valve and circulation valve are open such that slurry may pass down through the pipe string, through said crossover valve, into that portion of the annulus between said screen assembly and said casing below said packer, up the flow bore of said wash pipe to the annulus between said pipe string and said casing above said packer.

36. The gravel pack system of claim 30 further including means for positioning said crossover assembly within said screen assembly at a reverse circulation position;

a seal on said crossover assembly is in sealing engagement with the seal bore of said packer for flow of fluid down the annulus between said pipe string and said casing and through said crossover valve for flow of fluid up said pipe string.

37. The gravel pack system of claim 30 wherein said crossover assembly and screen assembly also form a screen valve for opening and closing a flow path through said screen between said flow bore and the annulus below said packer upon the upward movement of said crossover assembly within said screen assembly.

38. A method for gravel packing a formation in a well which comprises:

running a screen assembly having a packer, crossover tool, and production screen into the well and setting the packer above the formation to form an annulus adjacent the formation;

sequentially raising the crossover tool to perform the steps of lower squeeze opening the flow of gravel to the annulus and formation and closing the production screen and the flow of returns to the surface;

lower circulation opening the flow of gravel to the annulus and formation, maintaining the production screen closed, and opening the flow of returns to the surface;

upper circulation opening the flow of gravel to the annulus and formation and opening the production screen for flow of the returns to the surface;

upper squeeze opening the flow of gravel to the annulus and formation and through the production screen and closing the flow of returns to the surface; and reverse circulation closing the annulus and opening the crossover tool for the reverse flow of fluid to the surface.

* * * * *